US005101811A

United States Patent [19]

Brunswick

[11] Patent Number: 5,101,811

[45] Date of Patent: Apr. 7, 1992

[54] FITTED SEATING APPARATUS AND MANUFACTURE

[76] Inventor: Sumner Brunswick, 858 Huntington Ave., Boston, Mass. 02115

[21] Appl. No.: 627,879

[22] Filed: Dec. 13, 1990

Related U.S. Application Data

[63] Continuation of Ser. No. 411,684, Sep. 25, 1989, abandoned.

[51] Int. Cl.[5] ..... A61F 5/01; A47C 17/04

[52] U.S. Cl. ..... 297/284 C; 297/112; 297/DIG. 4

[58] Field of Search ..... 128/68, 68.1, 69, 78, 128/112.1, 115.1, 116.1; 297/112, 113, 114, 353, 383, 284, 281, DIG. 4

[56] References Cited

U.S. PATENT DOCUMENTS

| | | | |
|---|---|---|---|
| Re. 27,176 | 9/1971 | Froelich | 128/68 |
| 2,659,418 | 11/1953 | Berman | 128/68 |
| 2,759,475 | 9/1953 | Swaay | 128/90 |
| 2,781,757 | 2/1957 | Hauser et al. | 128/89 |
| 2,800,129 | 7/1957 | Swaay | 128/90 |
| 3,302,642 | 2/1967 | Allen | 128/90 |
| 3,490,444 | 1/1970 | Larson | 128/90 |
| 3,501,427 | 3/1970 | Edenbaum | 260/23 |
| 3,662,057 | 5/1972 | Webster et al. | 264/321 |
| 3,819,796 | 6/1974 | Webster et al. | 264/321 |
| 3,906,943 | 9/1975 | Arluck | 128/90 |
| 3,927,665 | 12/1975 | Wax | 128/78 |
| 3,998,219 | 12/1976 | Mercer et al. | 128/89 R |
| 4,006,741 | 2/1977 | Arluck | 128/90 |
| 4,019,505 | 4/1977 | Wartman | 128/90 |
| 4,193,395 | 3/1980 | Gruber | 128/90 |
| 4,226,230 | 10/1980 | Potts | 128/90 |
| 4,357,725 | 11/1982 | Ahlm | 5/468 |
| 4,474,840 | 10/1984 | Adams | 428/71 |
| 4,475,543 | 10/1984 | Brooks et al. | 128/78 |
| 4,572,167 | 2/1986 | Brunswick | 128/68 |
| 4,716,892 | 1/1988 | Brunswick | 128/77 |
| 4,883,320 | 11/1989 | Izumida et al. | 297/284 |

FOREIGN PATENT DOCUMENTS

| | | |
|---|---|---|
| 1590583 | 3/1981 | United Kingdom . |
| 2206787 | 7/1987 | United Kingdom . |

*Primary Examiner*—Richard J. Apley
*Assistant Examiner*—Lynne Reichard
*Attorney, Agent, or Firm*—Lahive & Cockfield

[57] ABSTRACT

A custom-fitted seating device has a back supporting structural brace element removably and replacably housed in a pocket of a seat back cushion. The brace element has a selected lumbosacral or other anatomical contour fitted to match the person being seated. A positioning element locates the brace element in an adjustably selected supporting location. The seating device can be an accessory seat back placed on a conventional seat, such as an automatic seat, or can be a free standing seat.

18 Claims, 3 Drawing Sheets

FITTED SEATING APPARATUS AND MANUFACTURE

This application is a continuation of application Ser. No. 411,684, filed Sept. 25, 1989, now abandoned.

BACKGROUND

This invention provides seating apparatus readily custom fitted to a person's body, and provides a method of manufacturing such seating apparatus.

The invention is useful in a variety of seating devices, including chairs and seats of all kind—such as seating furniture, wheelchairs, and the driver—s seat in a car or other vehicle—as well as accessory seat supports and backrests.

The individual custom fitting of seating structures according to the invention provides anatomical support for a seated person, including for example the lumbosacral region. The seating structures of the invention can also provide custom fitted buttock support.

The invention thus provides comfortable, restful, and orthopedically supportive seating. It is particularly useful for persons with orthopedic difficulties and discomfort, as well as for persons subject to prolonged sitting such as truck and bus drivers, among others.

The manufacturing method according to the invention can be practiced quickly to provide a custom fitted seating structure of the above character that is essentially permanent and yet that can be readily replaced or refitted.

Custom fitted orthoses are known that attach to a person's body, typically by way of straps and belts, and hence are worn like a corset garment. Examples are disclosed in U.S. Pat. Nos. 4,572,167 and 4,716,892, and in the art cited in those patents, and include the products of numerous companies including those of Brunswick Medical Corporation of Brookline, Mass., U.S.A.

It also known to provide seating devices, for example in automobiles, that are adjustable to provide a limited range of dorsal support configurations.

It is an object of this invention to provide anatomically fitted support, such as was heretofore available only in orthoses, in seating devices.

More particularly, it is an object of this invention to provide seating devices anatomically custom fitted to the person to be seated. It is also an object that such custom fitted seating devices be suited for diverse applications, including accessory supports for seating structures and as an integral part of seating structures.

Other objects of the invention are to provide such custom fitted orthodic seating devices that are relatively low in cost, that are substantially permanent yet suited for ready refitting and changing, and that can be manufactured readily.

Another object of the invention is to provide a process for the manufacture of seating devices having the above anatomical custom fitting.

Other objects of the invention will in part be obvious and will in part appear hereinafter.

SUMMARY OF THE INVENTION

A seating device according to the invention has a cushion element that carries a fitted brace element. The cushion element carries the brace element in readily removable and replacable manner that enables the brace element to be fitted to a person separate from the cushion element, and thereafter to be installed in the cushion element. This arrangement also allows the brace element to be refitted, removed or replaced, without removal or replacement of the cushion element.

A positioning element enables the brace element to be adjustably positioned for optimal support of a seated person. The positioning element can allow positioning movement of the brace element relative to a seat device or relative to the cushion element. The positioning element also can allow the cushion element to be adjustably positioned relative to a seat structure.

One illustrative embodiment of the invention is an accessory backrest for use on a seat device such as an automobile driver's seat or an office chair. The cushion element of the accessory backrest attaches, typically by way of straps, to the upright back of the seat device. The cushion element has an internal pocket that receives the fitted brace element. The brace element can be adjustably located within the pocket of the cushion element. It is an option that the cushion element can be adjustably positioned relative to the seat device on which it is used. In either case, the brace element is fitted to the anatomical contour of an individual person prior to being installed in the cushion element. The contoured and installed brace element provides an unusually high degree of dorsal orthodic support, yet it is readily removable for installation on another seating structure or to accommodate a different individual's brace element or, as a further alternative, for refitting the brace element to the individual.

In another embodiment of the invention, a cushion element arranged to hold a bracing element is incorporated into an otherwise conventional seating device, such as the driver's seat of a car, bus, truck or other vehicle or, as further examples, into a wheelchair or an otherwise conventional item of seating furniture. In the absence of the brace element, the seating device provides conventional support to a seated person. However, installing a brace element into the cushion element converts the seating device to provide a high degree of custom-fitted anatomical support, typically for at least the lumbosacral region or the buttock region, such as was heretofore available only in orthodic appliances.

A seating device according to the invention can provide custom fitted dorsal support for any of various regions of the back, including the sacral, lumber, thorasic and cervical regions. It typically provides at least lumbosacral support, and is extended when described to provide, in addition, support for the thorasic and the cervical regions.

The brace element preferably can be adjustably positioned and located in the cushion element to ensure that it has the proper location for maximal support for the individual to whom it is fitted.

Embodiments of the invention include a buttock support. Examples include a back support having a fitted brace element and combined with a buttock support in an accessory for a conventional seat device, or arranged with a frame to provide both buttock and back supports in a free-standing seat device.

The buttock support can include a pocket or like structure for receiving a buttock supporting second brace element fitted to an individual's buttock anatomy, for further orthodic support and comfort.

Features of the invention thus include custom fitted seating apparatus having a back supporting brace element fitted to a selected dorsal contour and removably and replacably deployed with a seat-back cushion element. Such seating apparatus also has a positioning element for disposing the brace element, when assembled with the cushion element, in a selected dorsal supporting location.

A further feature is a positioning element that includes, in one embodiment, an attachment means on the brace element to attain selective adjustable positioning. The positioning element can include attachment means on the brace element and removably, replacably and adjustably engagable with a corresponding attachment means which the cushion element carries.

It is also a feature of the invention, in one embodiment, that a frame element mounts the cushion element for supporting engagement with the back of a seated person. The pocket of the cushion element is located to be openly accessible for the ready removement and replacement of the brace element. In this embodiment, the positioning element typically is arranged for positioning the brace element relative to the frame element.

The features of the invention further include a buttock supporting seat bottom, typically attached to the back supporting cushion element and, further, a buttock supporting brace element removably and replacably fitting within the seat bottom.

The method of the invention includes anatomically fitting a brace element to a person, and removably and replacably housing the brace element in a seat element to support a dorsal region of the seated person, and typically the lumbosacral region and/or the buttock region. The housing of the brace element includes positioning adjustment to the seated person.

The invention accordingly comprises the features of construction, combinations of elements and arrangements of parts exemplified in the constructions hereinafter set forth, comprises the article possessing the features, properties, and relation of elements exemplified in the following detailed disclosure, and comprises the several steps and the relation of one or more of such steps with respect to each of the others for providing such an article and such apparatus, all as exemplified in the following detailed disclosure, and the scope of the invention is indicated in the claims.

For a fuller understanding of the nature and objects of the invention, reference is to be had to the following detailed description, taking in connection with the accompanying drawings, in which:

FIG. 1 is a pictorial showing of accessory seating apparatus according to the invention and having a seat back cushion element that removably and replacably receives a back supporting brace element having a selected contour;

FIG. 2 further illustrates the disposition of the brace element in the cushion element of FIG. 1, and one construction for the cushion element;

DESCRIPTION OF ILLUSTRATED EMBODIMENTS

Figure 1:
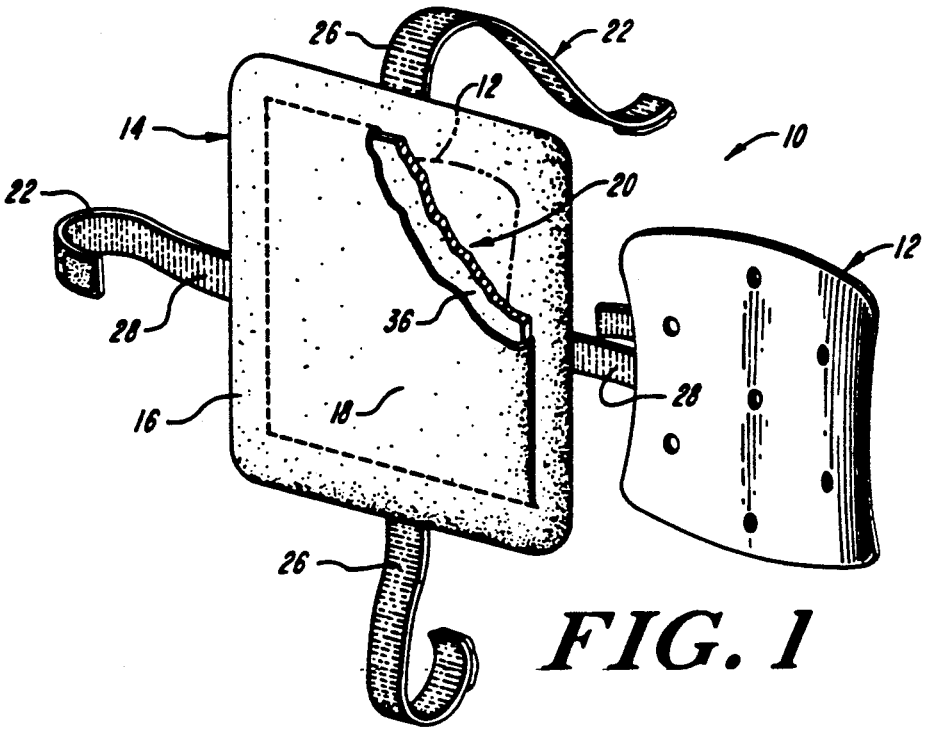

FIG. 1 shows custom fitted seating apparatus according to the invention in the form of an accessory back rest 10. The back rest 10 has a contoured brace element 12 that fits within a cushion element 14.

The brace element 12 is sized to overlie the part of a human back to be supported, and is contoured to the dorsal anatomy of a designated individual for whom the back rest 10 is to be used. The brace element 12 typically is contoured to at least the lumbosacral region, i.e. at the lower lumbar spine.

The illustrated cushion element 14 has a base portion 16 and a frontal portion 18, and forms a brace-receiving pocket 20 between the two portions.

Figure 2:
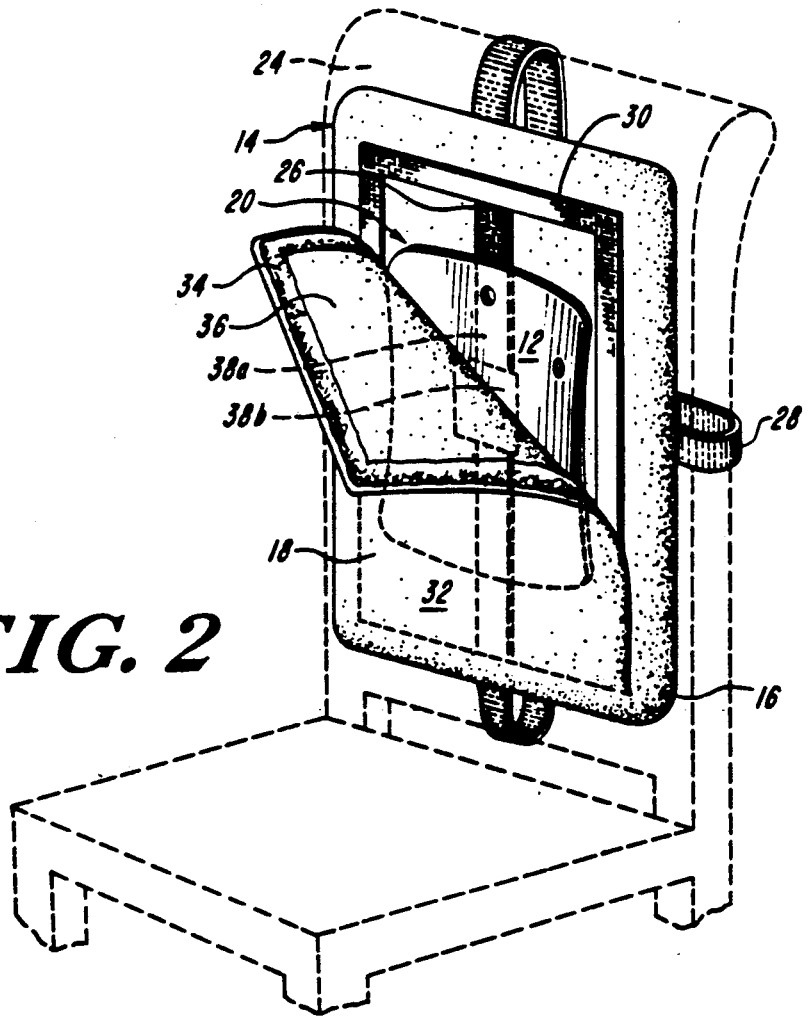

With reference to FIGS. 1 and 2, a further element of the back rest 10 is an adjustment element 22 for providing selected placement of the brace element 12 relative to the back of the chair or other host seat 24, designate in phantom FIG. 2, on which the back rest 10 is installed.

The adjustment element 22 of the illustrated back rest 10 includes a pair of belt like straps 26, 28, each attached to the cushion base portion 16. The illustrated strap 26 extends vertically above and below the cushion element for vertically encircling the host seat back; and the strap 28 extends horizontally for horizontally encircling the host seat back.

In the particular arrangement illustrated, the horizontal strap 28 is fixed, as by stitching, to the back portion 16, and the vertically extending strap 26 is slidably attached, as by passing through loops, to the base portion 16. Moreover, the vertical strap 26 is openly exposed along the back wall of the pocket 20 and carries a hook and loop fastener **38*a* along a length thereof that faces the back of the brace element 12, which carries a mating hook and loop fastener 38*b*. With this particular arrangement of the adjustment element, the cushion element 14 can be selectively positioned relative to the back of the host seat 24. Further, the brace element 12 can be selectively positioned within the pocket 20 and correspondingly relative to the seated individual both by placement of the brace fastening element 38*b* on the strap fastening element 38*a*, and by movement of the vertically extending strap 26 even when the cushion element 14 is secured in place on a host seat back 24 and without opening the pocket 20**.

With further reference to FIGS. 1 and 2, the illustrated cushion base portion 16 is essentially a cushion having fastening elements, illustrated as hook and loop fasteners 30, along both the side and top periphery of the pocket 20. The pocket 20, as illustrated, preferably extends over the major area of the cushion element front surface. The illustrated cushion front portion 18 has a fabric or like pliable cover 32 which overlies the pocket 20 and is attached to the base portion 16, illustratively by stitching at the bottom periphery of the pocket 20. The cushion front portion 18 also attaches to the base portion with hook and loop fasteners 34 that engage with the hook and loop fasteners 30 on the base portion 16. The illustrated front cover 36 includes a relatively thin layer of padding 36 that overlies the brace element 12 when inserted into the pocket 20, as illustrated.

The base portion 16 of the cushion element 14 thus attaches to the straps 26 and 28 for deploying and locating the back rest 10 and it forms, with the front portion 18, the pocket 20 that removably and replacably receives and thereby mounts the contoured brace element 12. The front cover 32 of the cushion element 14, in addition to pocketing the brace element 12 and thereby keeping it in place, overlies the panel element 12 and, with the pad 36 thereof, provides a padded and moisture absorbing comforting interface between the individual being supported and the brace element 12. The pad 36 also is shock-absorbing, to damp or suppress shocks to which the host seat 24 may be subjected, and thereby reduce their impact on the seated person.

The cushion element 14 can have structures and configurations other than that illustrated to provide the desired function of deploying the brace element to supportingly underlie a selected dorsal region of a seated person, and to accommodate selective positioning of the brace element relative to that person. The base portion 16, by way of illustrative example, alternatively can be a strong durable pliable sheet. The frontal portion 18 can likewise have many constructions to provide the desired padding and moisture absorption, and can be attached to the base element in numerous ways as those skilled in the art can practice in accord with this disclosure.

The panel element 12 of the back rest 10 preferably is a thermoformable panel of thermoplastic material, preferably a synthetic copolymer as described further in U.S. Pat. No. 4,572,167 and as marketed by Rohm & Haas under the trade designation Kydex. The brace element 12 typically, as illustrated, has a generally overall rectangular periphery, can be apertured for reduced weight and for ventilation, and has relatively smooth front and back walls uniformly spaced apart. The material of the brace element allows it to be contoured to an individual as indicated, and yet to be of high, substantially permanent strength with high memory for resuming the selectively contoured shape even after being stressed or otherwise elastically deformed. The brace panel can be fitted to the desired anatomical configuration by warming it sufficiently to become thermoformable, and by placing it over the lumbosacral region of the designated individual, with a heat barrier between, and molding it directly to the anatomical contour of the individual. The brace element 12 accordingly can be contoured as desired using an orthopedic binder as described in U.S. Pat. No. 4,572,167 and as further known using the custom molded orthoses of Brunswick Medical Corporation.

The accessory back rest 10 thus provides custom fitted seating that has the fit and support of a spinal orthoses and that has correspondingly high comfort. The brace element can, moreover, be readily removed and replaced by the brace element of a different individual when use of the seating device is to be changed, and can be refitted as needed.

Figure 3:
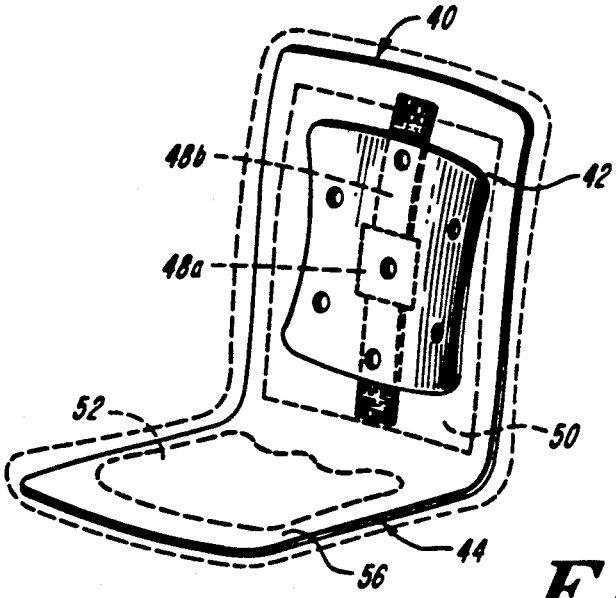
FIG. 3 shows a combined seat back cushion element and buttock supporting seat bottom, each having a fitted brace element in accordance with the invention.

FIG. 3 shows a custom-fitted seating article 40 that has a back support 42 and a buttock support 44. The back support carries a custom-fitted brace panel 46 that can be adjustably positioned, illustratively by way of mating hook and loop elements 48*a* and 48*b* secured respectively on the back of the brace panel 46 and on a facing wall of the back support 42. An optional front cover 50 of the back support 42 overlies the brace panel 46, all in a manner similar to that described for the back rest 10 of FIGS. 1 and 2.

The illustrated buttock support 44 likewise carries a custom-fitted brace element 52. The buttock support 44 deploys the brace element 52 with adjustable relative positioning to enable a seated person to locate the brace element 52 in full alignment with the buttock region seated thereon. Further the buttock support 44 deploys the brace element 52 so that it is removable and yet replaceable, to allow the brace element to be fitted initially to the designated person and to be removed, replaced, or refitted as needed. To provide these functions the buttock support 44 typically includes a cushion element 56 to underlie the buttock of a seated person and forming a pocket into which the brace element 52 can be fitted and positioned, in a manner analogous to the fitting of the brace panel 12 within the pocket 20 of the backrest article 10 described with reference to FIGS. 1 and 2.

With further reference to FIG. 3, the seating article 41 embodiment has pliable cushion elements that form the back support 42 and the buttocks support 44 and at least one of which carries a custom-fitted brace element 46, 52 in a removable and replacable, and adjustably positioned manner. This embodiment of the seating article 40 is for use as an accessory over a chair, car seat, or other seat device.

A further embodiment of the illustrated seating article 40 is a self-supporting seat device in which the back support 42 is firmly upstanding relative to the normally horizontal buttock support 44. Such a seating article can employ a rigid frame which supports the pliable cushion-like back support 42 and the buttock support 44. Another alternative is to form the back support 42 and the buttock support 44 of thermoformable material that is custom molded to the anatomy of the individual person to be seated at either or both the lumbosacral and/or the buttock region of that person. Such a free-standing thermoformed seating article 40 thus provides either or both illustrated brace elements 46 and 52 in a unitary one-piece structure.

Figure 4:
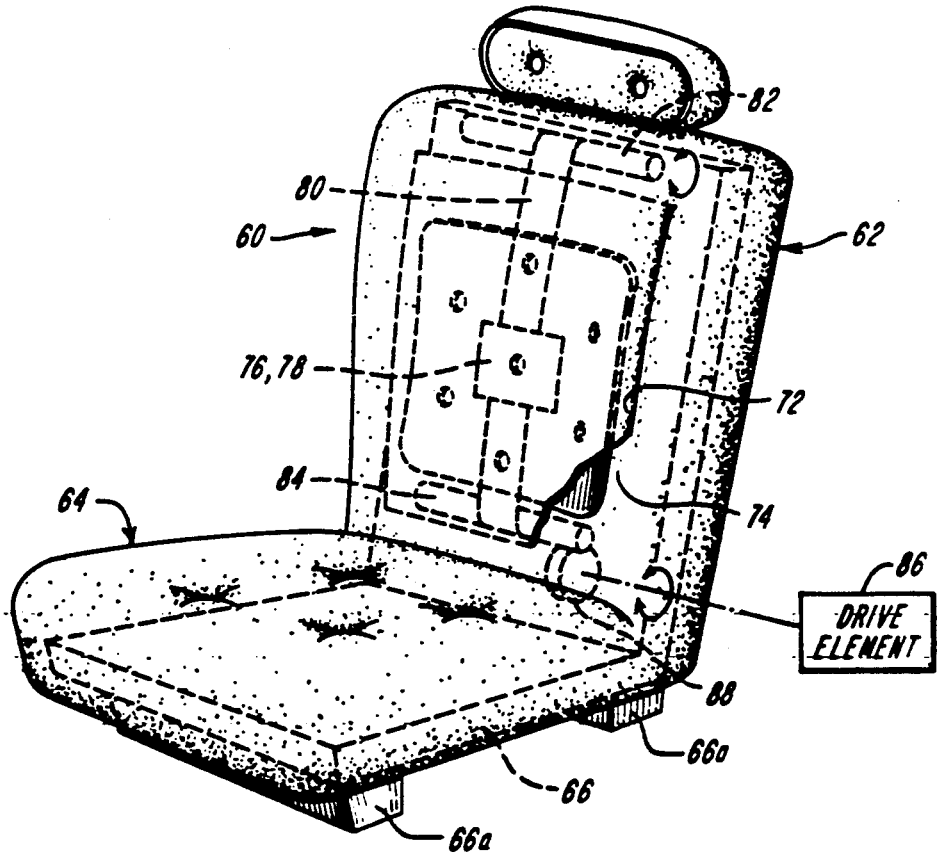
FIG. 4 illustrates a free standing seat device with a removable and replacable back supporting brace element in further accord with the invention.

FIG. 4 shows a seat device in the form of a chair 60 having an upright back cushion 62 and a horizontal bottom cushion 64. Typically a frame 66 of the seat secures the cushions 62 and 64 in selected upright and horizontal dispositions, respectfully, as shown and includes supports 66*a* for supporting the chair 60, whether on floor legs or other mounting as in a car or other vehicle or otherwise. The back cushion 62 mounts a fitted brace element 68 that can repeatedly be removed from, and alternatively installed in, the back cushion. The cushion 62 mounts the brace element 68 such that the brace element can be adjustably positioned, for example, up and down, into selected alignment and registration with a seated person.

The illustrated chair 60 provides this removable and replacable mounting of the brace element 68 with the back cushion 62 by having a pocket at the front of the back cushion and formed between an outer cover 72 and an inner wall 74. The illustrated outer cover 72 is a pliable cushioned panel stitched along one side to the back cushion 62 and secured along three remaining sides to the cushion by way of hook and loop fasteners. The outer cover accordingly when closed smoothly overlies the back cushion. Conversely, it can be, in effect, peeled away from the back cushion on three sides to allow full access to the pocket for placement and conversely removal of the brace element 68. The back cushion inner wall 74 carries an attachment element, for example, a panel of hook and loop fastener 76, and the back wall of the brace element 68 carries a mating hook and loop fastener 80 to thereby secure the brace element to the back cushion 62 by way of the inner wall 74.

With further reference to FIG. 4, the illustrated chair 60 has a readily operated adjustment for placement of the brace element 68 and which includes a looped strap 80 carried on two parallel rollers 82 and 84 which the frame 66 mounts in spaced parallel relationship as illustrated and each rotatable about its longitudinal shaft axis. The looped strap 80 carries the hook and loop fastener 76 to which the brace element 68 attaches. Further, a drive element 86, which can be an electric motor or a manually rotatable knob, is coupled, typically with suitable gear elements 88, to rotate the lower roller 84. Rotation of the shaft 84 by the drive element 86 thereby moves the looped strap 80, and thereby moves the brace element 68 upward or downward, depending on the direction of rotation. This adjustment mechanism accordingly allows a person seated on the chair 60 to selectively raise or lower the brace element 68, while remaining fully seated, to attain full alignment of the brace element with the person's body.

The brace element 68 is anatomically fitted to an individual person in the manner described above with reference to the articles of FIGS. 1, 2, and 3.

The chair bottom cushion 64 can be arranged to have a buttock supporting brace element in accord with the foregoing description, including the buttock supporting brace element 52 in the buttock support 44 of FIG. 3.

Figure 5:
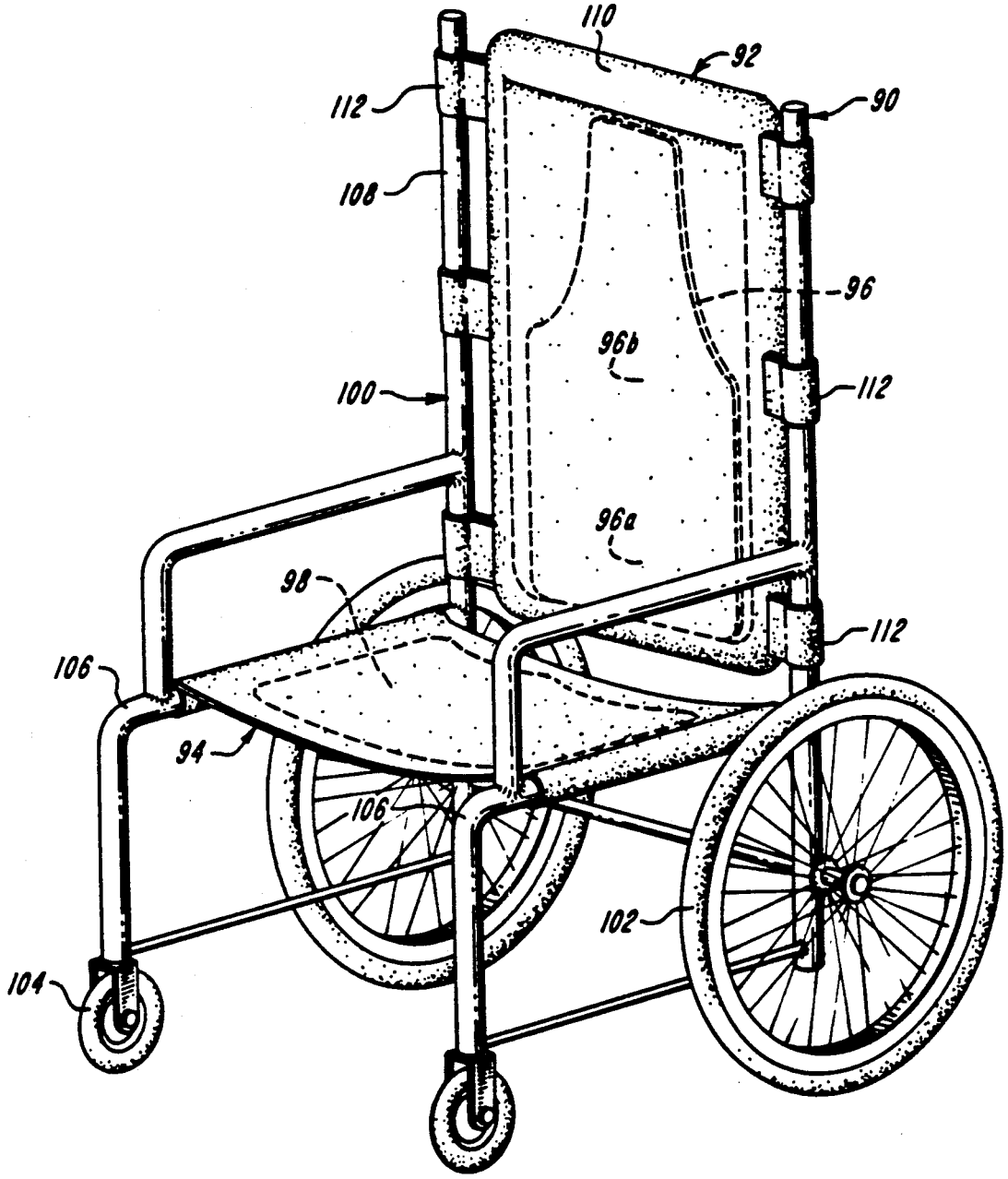
FIG. 5 shows a wheelchair fitted with a back support embodying features of the invention.

FIG. 5 shows a wheelchair 90 that has a custom fitted back support 92 and that can have a custom fitted buttock support 94, each employing a removable and replacable bracing panel 96 and 98 respectively. The illustrated wheelchair 90 has a frame 100 that mounts a pair of large wheels 102 and a pair of swiveling forward wheels 104, as is generally conventional. The frame 100 includes a pair of horizontal and spaced apart seat rails 106, and a pair of spaced apart and generally vertical back rails 108.

The illustrated back support 92 has a pliable back support panel 110 from which multiple loops 112 extend on each side for encircling engagement with one rail 108, for mounting the back support to the seat back rails 108,108. Each illustrated loop 112 encircles one rail and fastens in place, as by a buckle or other secure positive engagement.

The back support panel 110 has front and back walls secured together, as by stitching along the sides and along the bottom of the back support, and which are open at the top to form a wallet-like pocket into which the back brace panel 96 removably and replacably fits.

The illustrated back brace panel 96 has a lower lumbosacral support portion **96*a* from which a thorasic support region 96*b* extends upwardly. The bracing panel 96** is custom fitted, as previously described, to the individual to be supported.

With further reference to FIG. 5, the illustrated buttock support 94 similarly employs a pliable seat panel 116 secured to the frame by lateral extensions that loop around the seat rails 106,106 and positively buckle or otherwise fasten in place. The buttock support is formed with two layers or walls joined together as by stitching along the two sides of the chair and at either the front or back end, with the other end open to form a wallet-like pocket that removably and replacably receives the buttock brace panel 98. That brace panel also is custom fitted to the anatomical contour of the individual to be supported, as described.

The back support 92 and the buttock support 94 can, where desired, be arranged for adjustably selecting the position of each brace panel 96 and 98. This positional adjustment can, for example, use hook and loop fasteners arranged on each panel to engage a mating hook and loop fastener within the pocket that holds the panel. Further, it may be advantageous to thermoform either of both brace panels 96,98 directly on the wheelchair and with the individual to be fitted seated therein.

It will thus be seen that the invention described above efficiently attains the objects set forth above, among those made apparent from the preceding description. Since certain changes may be made in the above article and in the above constructions and method without departing from the scope of the invention, it is intended that all matter contained in the above description or shown in the accompanying drawings be interpreted as illustrative, and not in a limited sense.

It is also to be understood that the following claims are intended to cover all of the generic and specific features of the invention herein described, and all statements of the scope of the invention which as a matter of language might be said to fall therebetween.

Having described the invention, what is claimed as new and secured by Letters Patent is:

1. Custom fitted seating apparatus comprising

A. a back supporting structural brace element fitted to a selected lumbosacral contour, B. a seat-back cushion element having pocket means for removably and replacably receiving said brace element in a cushioned and back supporting disposition, and C. positioning means for selectively adjusting the dorsal supporting location of said brace element when received in said pocket means.

2. Seating apparatus according to claim 1 for use with a seat device having a back structure and in which A. said cushion element is arranged with said positioning means for removably and replacing overlying the back structure of a seat device, and B. said positioning means includes a pliable strap means for removably and replacably engaging the seat device back structure.

3. Seating apparatus according to claim 1 in which said positioning means includes attachment means on said brace element for the selective adjustable positioning of said brace element.

4. Seating apparatus according to claim 1 in which said positioning means includes A. first attachment means on said brace element, and B. second attachment means carried on said cushion element for selective positioning engagement with said first attachment means on said brace element when received in said pocket means.

5. Seating apparatus according to claim 1 in which said cushion element includes a cushioning panel arranged for overlying said brace element when received in said pocket means.

6. Seating apparatus according to claim 1 further comprising seat frame means mounting said cushion element for supporting engagement with the back of a seated person and disposed with said pocket means openly accessible for the removal and replacement of said brace element therein.

7. Seating apparatus according to claim 6 in which said positioning means includes means for selectively positioning said brace element relative to said frame means.

8. Seating apparatus according to claim 1 further comprising means forming a buttock supporting seat bottom element attached to said cushion element and forming, with said cushion element, a first-standing seat device.

9. Seating apparatus according to claim 8 in which said positioning means includes means for selectively positioning said brace element, when received in said pocket means, relative to said seat bottom element.

10. Seating apparatus according to claim 1 further comprising

A. a buttock-cushioning element attached to said cushion element and having second pocket means for removably and replacably receiving a buttock-brace element, and B. a structural buttock-brace element fitted to a selected anatomical contour and removably and replacably seated in said second pocket means.

11. Seating apparatus according to claim 1 further characterized for use by a designated individual, and in which said brace element is of thermoformable material and is individually thermoformed into said selected contour according to the designated individual.

12. Custom-fitted seating apparatus comprising

A. a structural brace element having a custom-fitted body supporting anatomical contour, B. a pocket element arranged for underlying a dorsal region of a seated person and for removably and replacably receiving said brace element for supporting that dorsal region of the seated person, and C. positioning means for selectively adjusting the dorsal supporting location of said brace element when received in said pocket means.

13. A method of manufacture of custom fitted seating apparatus comprising the steps of A. providing a seat-back cushion element having pocket means for removably and replacably receiving a brace element in a cushioned and back supporting disposition, B. fitting a back supporting structural brace element to a selected lumbosacral contour, and C. seating said fitted brace element removably and replacably into said pocket means of said seat-back cushion element.

14. Custom-fitted seating apparatus comprising

A. a structural brace element having a custom-fitted body supporting anatomical contour, B. deploying means for removably and replacably receiving said brace element and for disposing said brace element when received by said deploying means, for supportingly underlying a dorsal region of a seated person, and C. positioning means for selectively adjusting the dorsal supporting location of said brace element when received by said deploying means.

15. Seating apparatus according to claim 14 in which said positioning means includes selectively movable transport means for providing relative movement of said brace element when received by said deploying means.

16. Seating apparatus according to claim 14 in which said positioning means includes selectively movable transport means incorporating a drive element internal to said seating apparatus for providing relative movement of said brace element when received by said deploying means.

17. Seating apparatus according to claim 12 wherein said pocket element has fastening means for repeated removal and replacement of said brace element without removal or replacement of the pocket element.

18. Custom-fitted seating apparatus comprising

A. a back-supporting structural brace element individually custom fitted to the lumbosacral contour of an individual person, B. a seat-back cushion element having pocket means for removably and replacably receiving said brace element in a cushioned and back-supporting disposition, and C. positioning means for selectively adjusting the dorsal supporting location of said brace element, when received in said pocket means, for the individual to whom it is fitted.

* * * * *